United States Patent [19]

Hens et al.

[11] 4,260,930

[45] Apr. 7, 1981

[54] CATHODE RAY TUBE GETTER HAVING TWO ARMS CONNECTED TO FINAL ELECTRODE BY INSULATING CONNECTOR

[75] Inventors: Theo Hens, Mol; Remi Wauters, Glabbeek, both of Belgium

[73] Assignee: GTE Sylvania, N.V., Tienen, Belgium

[21] Appl. No.: 88,329

[22] Filed: Oct. 25, 1979

[51] Int. Cl.[3] ..... H01J 29/94; H01J 31/00

[52] U.S. Cl. ..... 313/481; 313/174

[58] Field of Search ..... 313/481

[56] References Cited

U.S. PATENT DOCUMENTS 3,961,221 6/1976 Benda et al. ..... 313/481

4,153,857 5/1979 Delsing et al. ..... 313/481

FOREIGN PATENT DOCUMENTS 2424221 12/1974 Fed. Rep. of Germany ..... 313/481

*Primary Examiner*—Robert Segal

*Attorney, Agent, or Firm*—William H. McNeill

[57] ABSTRACT

An antenna getter assembly for cathode ray tubes includes an electrically insulating member between the getter ring and the electron gun. The insulating member is provided with a shield which protects the member from deposition of conductive materials thereon and also prevents electrostatic charging thereof. The assembly is employed in conjunction with high electrical resistance internal coatings.

3 Claims, 4 Drawing Figures

CATHODE RAY TUBE GETTER HAVING TWO ARMS CONNECTED TO FINAL ELECTRODE BY INSULATING CONNECTOR

TECHNICAL FIELD

This invention relates to getters and more particularly to antenna getters for cathode ray tubes. Still more particularly, the invention is concerned with electrical isolation and shielding of important parts of such a getter.

BACKGROUND ART

The employment of antenna getters in cathode ray tubes is well known. Further, it is known to use high electrical resistance material as the internal conductive coating in such tubes to limit arcing and to prevent damaging arcs from occuring between the closely spaced electrodes of the electron gun. When tubes employ high anode voltages, high resistance internal coatings and antenna getters, which getters are attached to the final electrode of the gun and extend into the tube envelope and contact the resistance material, it is necessary to include some form of electrical insulation between the getter and the gun to avoid shorting out the high resistance material and providing an arcing path. Numerous techniques have been proposed for achieving this insulating quality. In U.S. Pat. No. 3,961,221 the distal end of a getter wand is provided with a ceramic wheel which contacts the resistance material. U.S. Pat. No. 3,927,953 discloses a getter whose base is comprised of an electrically insulating ceramic ring. German Offenlegungsshrift No. DE-OS 26 52 277 discloses an antenna getter whose proximal end is electrically insulated from the final electrode of the electron gun by a glass or ceramic rod.

While all of the above-described antenna getters theoretically function well, it has been found in practice that the various electrically isolating elements used thereby tend to pick up conductive material during use. This conductive material often comes from the getter itself and provides an electrically conductive path which subsequently renders the device unsuitable for its purpose.

DISCLOSURE OF THE INVENTION

Accordingly, it is an object of the invention to obviate the disadvantages of the prior art.

It is another object of the invention to enhance the operation of cathode ray tubes.

These objects are accomplished, in one aspect of the invention, by the provision of an antenna getter assembly for cathode ray tubes employing arc limiting, high electrical resistance, internal conductive coatings. The getter assembly comprises an elongated metallic wand having one end thereof affixed to the final electrode of an electron gun and the other end thereof terminating in an electrically insulating connecting piece. A much shorter metallic section extends from the other end of the insulating connector piece and mounts a getter ring. A semi-circular upstanding shield is affixed to the getter ring facing the insulating connector piece. A second shield covers at least three sides of the insulating connector. These uniquely placed shields protect the insulating connector piece from unwanted depositions of conductive material, notably barium from the flashed getter, and thus protect the integrety of the insulator. Also, the shield over the insulating connector piece avoids electrostatic charging thereof during tube operation.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
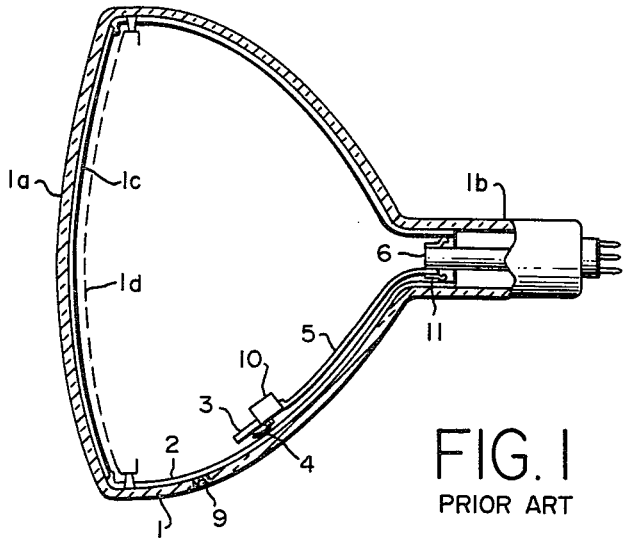
FIG. 1 PRIOR ART
FIG. 1 is an elevational, sectional view of a color cathode ray tube employing an antenna getter.

Referring now to the drawings with greater particularity, there is shown in FIG. 1 a sectional view of a color cathode ray tube having a funnel 1, a face plate 1a and a neck 1b. A cathodoluminescent screen 1c of known variety is positioned on the interior of face plate 1a and a shadow mask 1d is mounted adjacent thereto. An electrically conductive, high electrical resistance coating 2 is applied to the inside surface of funnel 1. By high electrical resistance is meant a coating providing a resistance of from about 50,000 ohms to 2 megohms measured between the gun snubbers and the second anode button.

The getter container or ring 3 carries the flashable getter material and rests upon the layer 2 through the intermediary of skid-shaped piece 4. Getter ring 3 is fixed to one end of an elongated, resilient supporting arm 5 whose other end is connected to the last electrode 6 of an electron gun.

Figure 3:
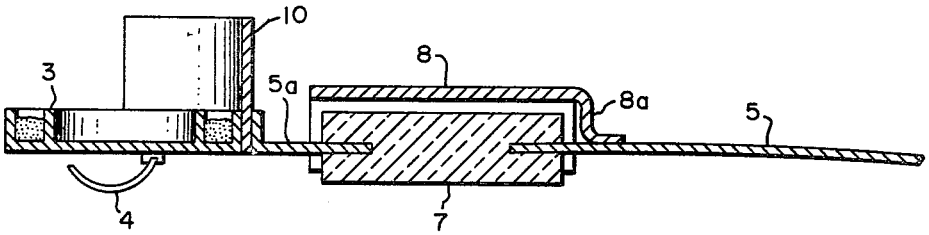
FIG. 3 is an enlarged sectional view of the getter ring and connector piece.
Figure 4:
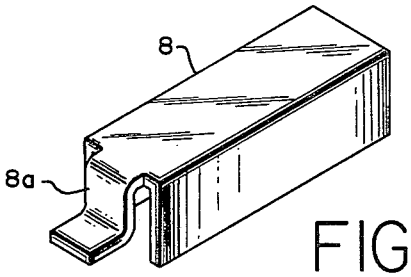
FIG. 4 is a perspective view of the connector piece shield.
Figure 2:
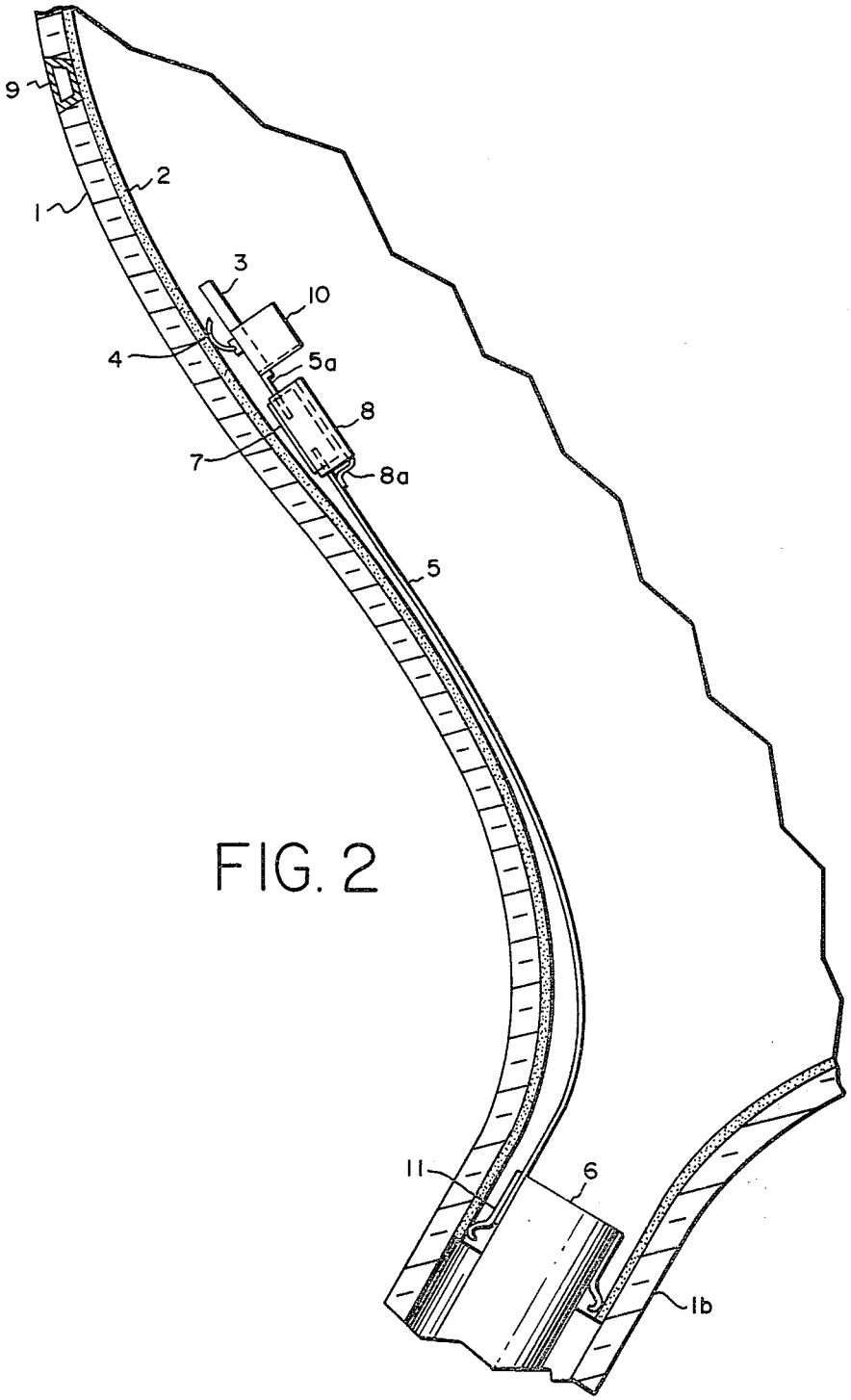
FIG. 2 is a partial, elevational sectional view of a tube section illustrating the getter assembly of the invention.

Referring now to FIGS. 2–4, the getter assembly of the invention is shown. Herein the resilient supporting arm 5 has the end thereof remote from electrode 6 fixed in an electrically insulating connector piece 7, of a suitable material such as glass or ceramic. A secondary arm 5a, much shorter than arm 5, projects from the other end of connector piece 7 and carries the getter ring 3 and a semi-circular, upstanding shield 10, which faces connector piece 7.

Connector piece 7 is shielded by shield 8 which covers the top and two sides of connector piece 7. One end of shield 8, which is closest to the electron source, is substantially closed by an "L" shaped tap 8a, the free end of which is attached to arm 5 to mount the shield. The shield reduces the possibility of stray capacitive charges building up on connector piece 7 from the impact of stray electrons, as well as protecting piece 7 from the deposition thereon of conducting particles from the flashed getter.

Arm 5 can be, and preferably is, provided with a longitudinal bracing rib (not shown) to aid in adapting the curve of the arm 5 to the contour of envelope 1.

While the figures (FIGS. 1 and 2) illustrate only the last electrode 6 of an electron gun, it will be understood that conventional, multi-electrode guns are employed. Contact fingers on snubbers 11, oriented in a direction opposite to gun insertion, are attached to electrode 6 and make contact with resistive layer 2.

In conventional tubes suitable for color presentation, electrode 6 will carry a potential of from 25 KV to 30KV, applied via button 9 through layer 2. Electrodes adjacent to electrode 6, on the other hand, may carry voltages of 4 KV to 6 KV, which voltages are supplied through the base of the tube.

In operation very few electrons will land on electrode 6, thus, almost no current will flow through the resistive layer 2 and, consequently, almost no voltage drop will occur and electrode 6 will have the voltage that is applied through button 9.

In color picture tubes, whose electron guns have small spacings between electrodes, high voltage arcs or flash-overs between electrodes having high potential differences therebetween cannot be completely avoided. These flash-overs can damage the electrodes or their associated circuitry. However, by using the high resistance layer 2, and the insulated and shielded getter assembly, the danger of these arc-overs is considerably reduced.

While there has been shown and described what is considered to be preferred embodiment of the invention, it will be apparent to those skilled in the art that various changes and modifications can be made herein without departing from the scope of the invention as defined by the appended claims.

We claim:

1. A getter assembly for a cathode ray tube, said cathode ray tube comprising a funnel, a face plate and a neck and having a high electrical resistance layer on the inside surface of said funnel and an electron gun in said neck, said getter assembly comprising: a relatively long supporting arm having one end attached to the final electrode of said electron gun and its other end fixed in an electrically insulating connector piece, said arm having a curvative substantially matching that of said funnel; a second arm fixed in the other end of said connector piece, said second arm carrying an annular getter; and a shield for said connector piece, said shield covering at least three sides of said connector piece and being attached at one end to said supporting arm, said getter being provided with a semi-circular upstanding shield facing said connector piece shield.

2. The getter assembly of claim 1 wherein said connector piece is of glass or ceramic.

3. The getter assembly of claims 1 or 2 wherein said getter is provided with a semi-circular upstanding shield which faces said connector piece shield.

* * * * *